US009443533B2

(12) United States Patent
Nongpiur

(10) Patent No.: US 9,443,533 B2
(45) Date of Patent: Sep. 13, 2016

(54) MEASURING AND IMPROVING SPEECH INTELLIGIBILITY IN AN ENCLOSURE

(71) Applicant: Rajeev Conrad Nongpiur, Richmond (CA)

(72) Inventor: Rajeev Conrad Nongpiur, Richmond (CA)

( * ) Notice: Subject to any disclaimer, the term of this patent is extended or adjusted under 35 U.S.C. 154(b) by 233 days.

(21) Appl. No.: 14/318,720

(22) Filed: Jun. 30, 2014

(65) Prior Publication Data

US 2015/0019212 A1 Jan. 15, 2015

Related U.S. Application Data

(60) Provisional application No. 61/846,561, filed on Jul. 15, 2013.

(51) Int. Cl.
*G10L 21/0364* (2013.01)
*G10L 21/0208* (2013.01)
*G10L 21/0232* (2013.01)

(52) U.S. Cl.
CPC ..... *G10L 21/0364* (2013.01); *G10L 21/0208* (2013.01); *G10L 21/0232* (2013.01)

(58) Field of Classification Search
CPC ..... G10L 21/0364; G10L 2021/02166; G10L 2021/03643; G10L 2021/03646; G10L 2021/02087; G10L 21/0232
USPC ..... 704/225, 226; 381/94.2, 94.3, 57, 59, 381/71.4, 71.11
See application file for complete search history.

(56) References Cited

U.S. PATENT DOCUMENTS

| | | | | |
|---|---|---|---|---|
| 5,119,428 | A * | 6/1992 | Prinssen | G10K 15/10 381/63 |
| 7,702,112 | B2 * | 4/2010 | Obranovich | G08B 29/10 367/136 |
| 8,098,833 | B2 * | 1/2012 | Zumsteg | G10L 25/69 381/111 |
| 8,103,007 | B2 * | 1/2012 | Shields | G10L 25/69 381/111 |
| 8,489,393 | B2 * | 7/2013 | Alves | G10L 21/0364 375/243 |
| 8,565,415 | B2 * | 10/2013 | Schmidt | H04M 9/082 379/390.03 |
| 2005/0135637 | A1 * | 6/2005 | Obranovich | G08B 29/10 381/92 |

(Continued)

OTHER PUBLICATIONS

Makhijani et al.; "Improving speech intelligibility in an adverse condition using subband spectral subtraction method"; Feb. 2011; IEEE; 2011 International Conference on Communications and Signal Processing (ICCSP);pp. 168-170.*

(Continued)

*Primary Examiner* — John Villecco

(57) ABSTRACT

A method for accurately estimating and improving the speech intelligibility from a loudspeaker (LS) is disclosed. A microphone is placed in a desired position and using an adaptive filter, an estimate of the clean speech signal at the microphone is generated. By using the adaptive-filter estimate of the clean speech signal and measuring the background noise in the enclosure an accurate Speech Intelligibility Index (SII) or Articulation Index (AI) measurement at the microphone position is obtained. On the basis of the estimated speech intelligibility measurement, a decision can be made if the LS signal needs to be modified to improve the intelligibility.

20 Claims, 9 Drawing Sheets

(56) References Cited

U.S. PATENT DOCUMENTS

2009/0097676 A1* 4/2009 Seefeldt ..... H04S 7/00 381/107
2009/0132248 A1* 5/2009 Nongpiur ..... G10L 21/0208 704/233
2009/0225980 A1* 9/2009 Schmidt ..... H04M 9/082 379/406.02
2009/0281803 A1* 11/2009 Chen ..... G10L 21/0208 704/226
2011/0096915 A1* 4/2011 Nemer ..... H04M 3/568 379/158
2011/0125491 A1* 5/2011 Alves ..... G10L 21/0364 704/207
2011/0125494 A1* 5/2011 Alves ..... G10L 21/0208 704/226
2011/0191101 A1* 8/2011 Uhle ..... G10L 21/0208 704/205
2013/0304459 A1* 11/2013 Pontoppidan ..... H03G 3/00 704/207
2014/0188466 A1* 7/2014 LeBlanc ..... G10L 21/0208 704/226
2015/0019213 A1* 1/2015 Nongpiur ..... G10L 21/0364 704/225
2015/0325250 A1* 11/2015 Woods ..... G10L 21/0208 704/205

OTHER PUBLICATIONS

Begault et al.; "Speech Intelligibility Advantages using an Acoustic Beamformer Display"; Nov. 2015; Audio Engineering Society, Convention e-Brief 211; 139$^{th}$ Convention.*

* cited by examiner

MEASURING AND IMPROVING SPEECH INTELLIGIBILITY IN AN ENCLOSURE

RELATED APPLICATIONS

This application claims priority to U.S. Provisional Patent Application No. 61/846,561, filed Jul. 15, 2013, entitled MEASURING AND IMPROVING SPEECH INTELLIGIBILITY IN AN ENCLOSURE, the contents of which are incorporated by reference herein in their entirety for all purposes.

BACKGROUND

This invention generally relates to measuring and improving speech intelligibility in an enclosure or an indoor environment. More particularly, embodiments of this invention relate to accurately estimating and improving the speech intelligibility from a loudspeaker in an enclosure.

Ensuring intelligibility of loudspeaker signals in an enclosure in the presence of time-varying noise is a challenge. In a vehicle or a train or an airplane, interference may come from many sources including engine noise, fan noise, road noise, railway track noise, babble noise, and other transient noises. In an indoor environment, interference may come from many sources including a music system, television, babble noise, refrigerator hum, washing machine, lawn mower, printer, and vacuum cleaner.

Accurately estimating the intelligibility of the loudspeaker signal in the presence of noise is critical when modifying the signal in order to improve its intelligibility. Additionally, the way the signal is modified also makes a big difference in performance and computational complexity. There is a need for an audio intelligibility enhancement system that is sensitive, accurate, works well even in low loudspeaker-power constraints, and has low computational complexity.

It will be appreciated that these systems and methods are novel, as are applications thereof and many of the components, systems, methods and algorithms employed and included therein. It should be appreciated that embodiments of the presently described inventive body of work can be implemented in numerous ways, including as processes, apparata, systems, devices, methods, computer readable media, computational algorithms, embedded or distributed software and/or as a combination thereof. Several illustrative embodiments are described below.

SUMMARY

A system that accurately estimates and improves the speech intelligibility from a loudspeaker (LS) in an enclosure. The system includes a microphone or microphone array that is placed in the desired position, and using an adaptive filter an estimate of the clean speech signal at the microphone is generated. By using the adaptive-filter estimate of the clean speech signal and measuring the background noise in the enclosure an accurate Speech Intelligibility Index (SII) or Articulation Index (AI) measurement at the microphone position is obtained. On the basis of the estimated speech intelligibility measurement, a decision can be made if the LS signal needs to be modified to improve the intelligibility.

To improve the speech intelligibility of the LS signal, a frequency-domain approach may be used, whereby an appropriately constructed spectral mask is applied to each spectral frame of the LS signal to optimally adjust the magnitude spectrum of the signal for maximum speech intelligibility, while maintaining the signal distortion within prescribed levels and ensuring that the resulting LS signal does not exceed the dynamic range of the signal.

Embodiments also include a multi-microphone LS-array system that improves and maintains uniform speech intelligibility across a desired area within an enclosure.

BRIEF DESCRIPTION OF THE DRAWINGS

The inventive body of work will be readily understood by referring to the following detailed description in conjunction with the accompanying drawings, in which.

DETAILED DESCRIPTION

A detailed description of the inventive body of work is provided below. While several embodiments are described, it should be understood that the inventive body of work is not limited to any one embodiment, but instead encompasses numerous alternatives, modifications, and equivalents. In addition, while numerous specific details are set forth in the following description in order to provide a thorough understanding of the inventive body of work, some embodiments can be practiced without some or all of these details. Moreover, for the purpose of clarity, certain technical material that is known in the related art has not been described in detail in order to avoid unnecessarily obscuring the inventive body of work.

Figure 1:
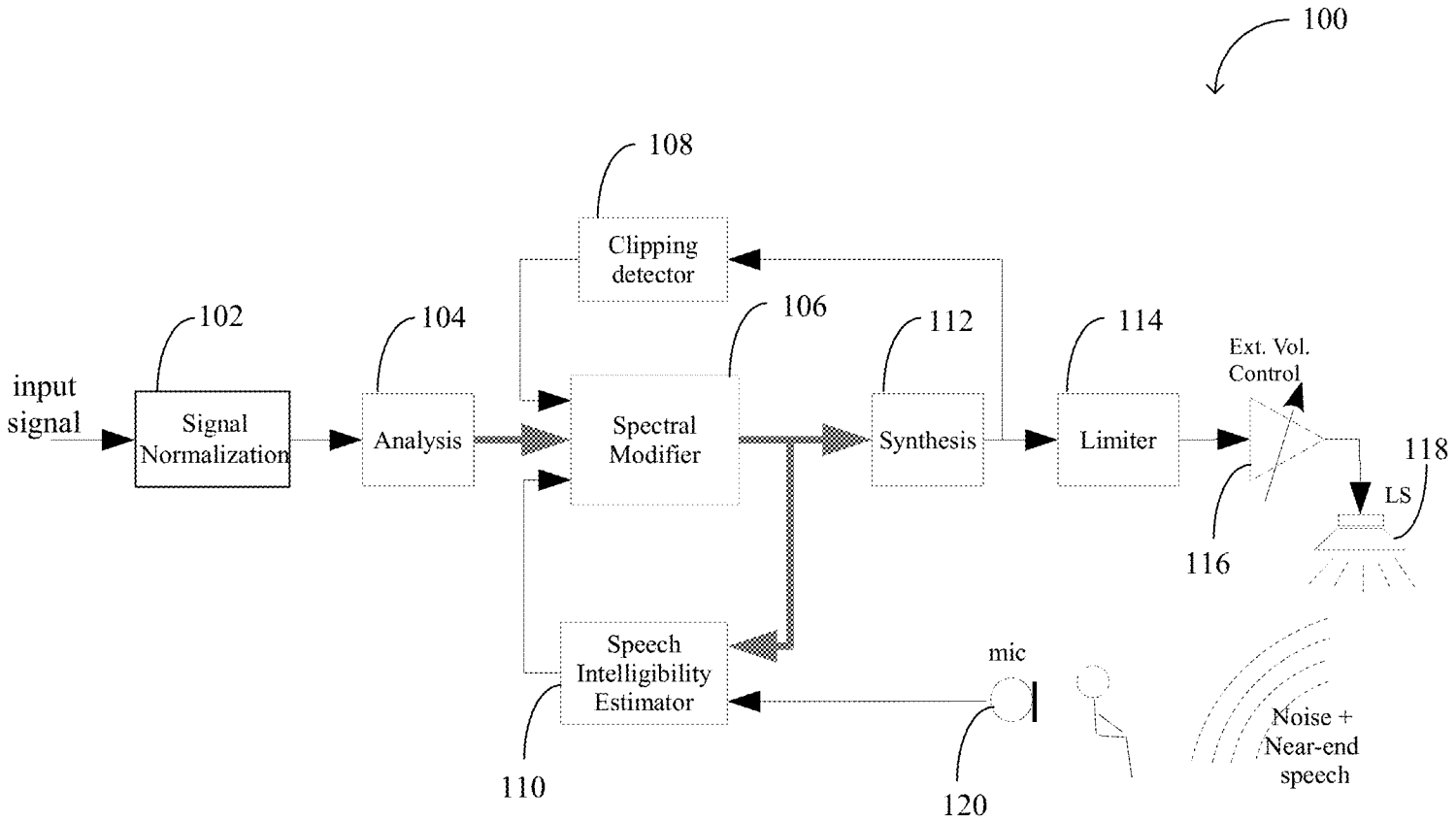
FIG. 1 illustrates diagram of a system for estimating and improving the speech intelligibility in an enclosure.

FIG. 1 illustrates a block diagram of a system 100 for estimating and improving the speech intelligibility in an enclosure. The system 100 includes a signal normalization module 102, an analysis module 104, a spectral modifier module 106, a clipping detector 108, a speech intelligibility estimator 110, a synthesis module 112, a limiter module 114, and an external volume control 116, a loudspeaker 118, and a microphone 120.

The signal normalization module 102 receives an input signal (e.g., a speech signal, audio signal, etc.) and adaptively adjusts the spectral gain and shape of the input signal so that the medium to long term average of the magnitude-spectrum of the input signal is maintained at a prescribed spectral gain and/or shape. Various techniques may be used to perform such spectral maintenance, such as automatic gain control (AGC), microphone normalization, etc. In this particular embodiment, the input signal is a time-domain signal on which signal normalization is performed. However, in other embodiments, signal normalization may be performed in the frequency domain and accordingly may receive and process a signal in the frequency domain and/or receive a time-domain signal and include a time-domain/frequency domain transformer.

The analysis module 104 receives the spectrally-modified output signal from the signal normalization module 102 in the time domain and decomposes the time-domain signal into subband components in the frequency domain by using an analysis filterbank. The analysis module 104 may include one or more analog or digital filter components to perform such frequency translation. In other embodiments, however, it should be appreciated that such time/frequency translations may be performed at other portions of the system 100.

The spectral modifier module 106 receives the subband components output from the analysis module 104 and performs various processing on those components. Such processing includes modifying the magnitude of the subband components by generating and applying a spectral mask that is optimized for improving the intelligibility of the signal. To perform such modification, the spectral modifier module 106 may receive the output of the analysis module 104 and, in some embodiments, the output of the clipping detector 108 and/or speech intelligibility estimator 110.

The synthesis module 112 in this particular embodiment receives the output of the spectral modifier 106 which, in this particular example, are subband component outputs and recombines those subband components to form a time-domain signal. Such recombination of subband components may be performed by using one or more analog or digital filters arranged in, for example, a filter bank.

The clipping detector 108 receives the output of the synthesis module 112 and based on that output detects if the input signal as modified by the spectral modifier module 106 has exceeded a predetermined dynamic range. The clipping detector 108 may then communicate a signal to the spectral modifier module 106 indicative of whether the input signal as modified by the spectral modifier module 106 has exceeded the predetermined dynamic range. For example, the clipping detector 108 may output a first value indicating that the modified input signal has exceeded the predetermined dynamic range and a second (different) value indicating that the modified input signal has not exceeded the predetermined dynamic range. In some embodiments, the clipping detector 108 may output information indicative of the extent of the dynamic range being exceeded or not. For example, the clipping detector 108 may indicate by what magnitude the dynamic range has been exceeded.

The speech intelligibility estimator 110 estimates the speech intelligibility by measuring either the SII or the AI. Speech intelligibility refers to the ability to understand components of speech in an audio signal, and may be affected by various speech characteristics such as spoken clarity, spoken clarity, explicitness, lucidity, comprehensibility, perspicuity, and/or precision. SII is a value indicative of speech intelligibility. Such value may range, for example, from 0 to 1, where 0 is indicative of unintelligible speech and 1 is indicative of intelligible speech. AI is also a measure of speech intelligibility, but with a different framework for making intelligibility calculations.

The speech intelligibility estimator 110 receives signals from a microphone 120 located at a listening environment as well as the output of the spectral modifier module 106. The speech intelligibility estimator 110 calculates the SII or AI based on the received signals, and outputs the SII or AI for use by the spectral modifier 106.

It should be appreciated that embodiments are not necessarily limited to the system described with reference to FIG. 1 and the specific components of the system described with reference to FIG. 1. That is, other embodiments may include a system with more or fewer components. For example, in some embodiments, the signal normalization module 102 may be excluded, the clipping detector 108 may be excluded, and/or the limiter 114 may be excluded.

Figure 2:
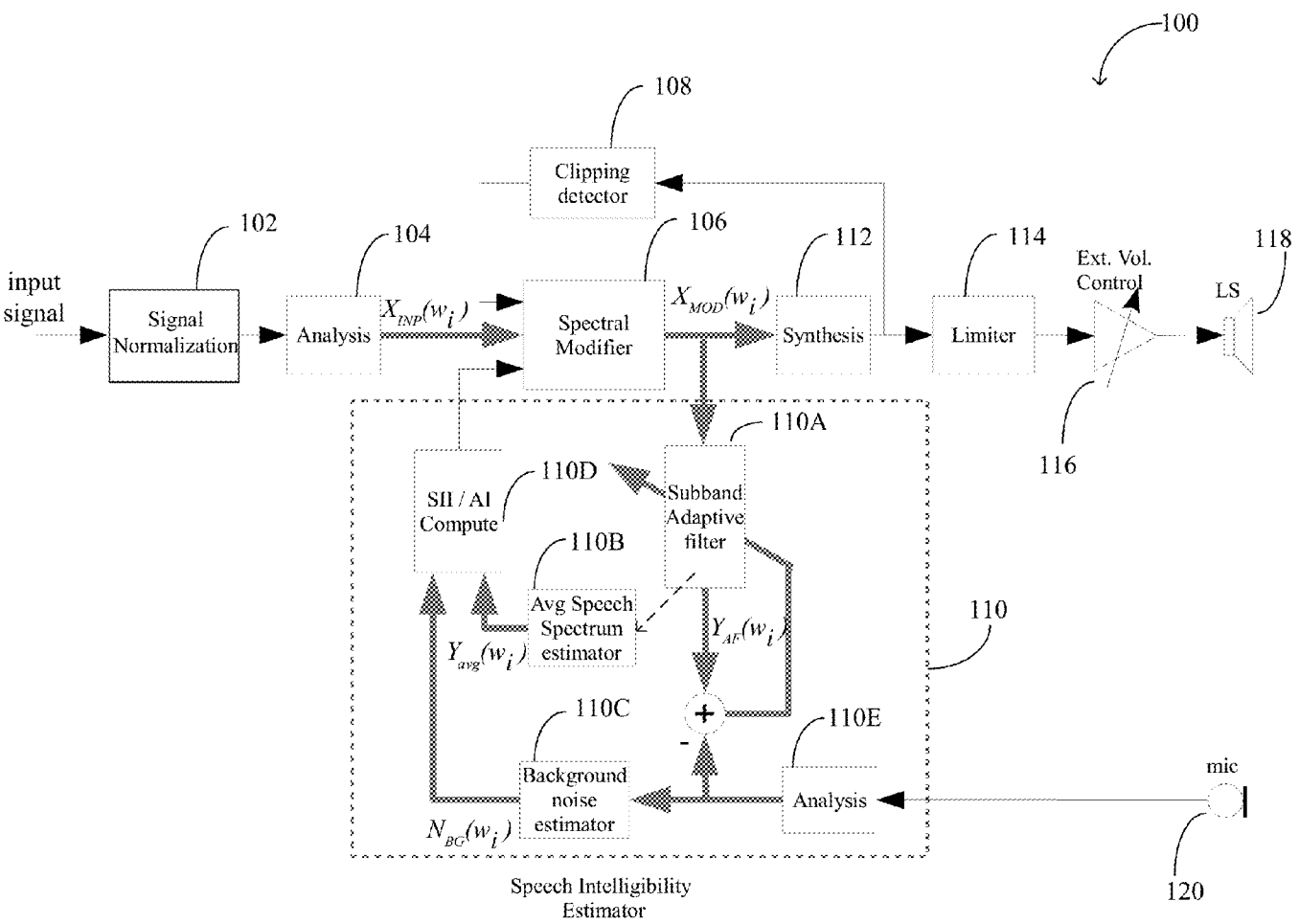
FIG. 2 illustrates a detailed block diagram of a speech intelligibility estimator that uses a subband adaptive filter according to a first embodiment.

FIG. 2 illustrates a detailed block diagram of a speech intelligibility estimator 110 that uses a subband adaptive filter according to a first embodiment. The speech intelligibility estimator 110 may use an adaptive filter to compute the medium- to long-term magnitude spectrum of the LS signal at the microphone and a noise estimator to measure the background noise of the signal. The estimated magnitude spectrum and the background noise may then be used to compute the SII or AI. In another embodiment and as also described with reference to FIG. 2, the speech intelligibility estimator 110 may compute the SII or AI without computing the medium- to long-term magnitude spectrum of the LS signal.

The limiter module 114 receives the output from the synthesis module 112 and attenuates signals that exceed the predetermined dynamic range with minimal audible distortion. Though the system exclusive of the limiter 114 dynamically adjusts the input signal so that it lies within the predetermined dynamic range, a sudden large increase in the input signal may cause the output to exceed the predetermined dynamic range momentarily before the adaptive functionality eventually brings the output signal back within the predetermined dynamic range. The limiter module 114 may thus operate to prevent or otherwise reduce such audible distortions.

FIG. 2 illustrates a more detailed block diagram of a speech intelligibility estimator 110 that uses a subband adaptive filter. The speech intelligibility estimator 110 includes a subband adaptive filter 110A, an average speech spectrum estimator 110B, a background noise estimator 110C, an SII/AI estimator 110D, and an analysis module 110E.

The subband adaptive filter 110A receives the output of the spectral modifier module 106 ($X_{MOD}(w_i)$) and outputs subband estimates $Y_{AF}(w_i)$ of the LS signal (i.e., the signal output from the loudspeaker 118) as would be captured by the microphone 120, but unlike the microphone signal (i.e., the signal actually measured by the microphone 120) it has the advantage of containing no background noise or near-end speech. The subband estimates $Y_{AF}(w_i)$ are compared with the output of the analysis module 110E to determine the difference thereof. That difference is used to update the filter coefficients of the subband adaptive filter 110A.

The filter coefficients of the subband adaptive filter 110A model the channel from the output of the synthesis module 112 to the output of the analysis module 110E. In this particular embodiment, the filter coefficients of the subband adaptive filter 110A may be used by the average speech spectrum estimator 110B (represented by the dotted arrow extending from the subband adaptive filter 110A to the average speech spectrum estimator 110B).

Generally, the average speech spectrum estimator 110B may generate the average speech magnitude spectrum at the microphone, $Y_{avg}(w_i)$, based on the filter coefficients of the subband adaptive filter 110A, the average magnitude spectrum $X_{avg}(w_i)$ of the normalized spectrum $X_{INP}(w_i)$, where the normalized spectrum $X_{INP}(w_i)$ is the frequency domain spectrum of the normalized time-domain input signal, and the spectral mask $M(w_i)$ determined by the spectral modifier module 106.

More specifically, the average speech spectrum estimator 110B may determine the average speech magnitude spectrum at the microphone, $Y_{avg}(w_i)$, as $$Y_{avg}(w_i)=M(w_i)X_{avg}(w_i)G_{FD}(w_i)$$

where $$G_{FD}(w_i)=\sqrt{\Sigma_k|H_i(k)|^2}$$

$H_i(k)$ is the kth complex adaptive-filter coefficient in the ith subband, and $X_{avg}(w_i)$ is the average magnitude spectrum of the normalized spectrum $X_{INP}(w_i)$, and $M(w_i)$ is the spectral mask that is applied by the spectral modifier module 106 to improve the intelligibility of the signal, where some techniques for calculating the spectral mask $M(w_i)$ are subsequently described.

The background noise estimator 110C receives the output of the analysis module 110E and computes and outputs the estimated background noise spectrum $N_{BG}(w_i)$ of the signal received by the microphone 120. The background noise estimator 110C may use one or more of a variety of techniques for computing the background noise, such as a leaky integrator, leaky average, etc.

The SII/AI estimator 110D computes the SII and/or AI based on the average speech spectrum $Y_{avg}(w_i)$ and the estimated background noise spectrum $N_{BG}(w_i)$. The SII/AI computation may be performed using a variety of techniques, including those defined by the American National Standards Institute (ANSI).

Figure 3:
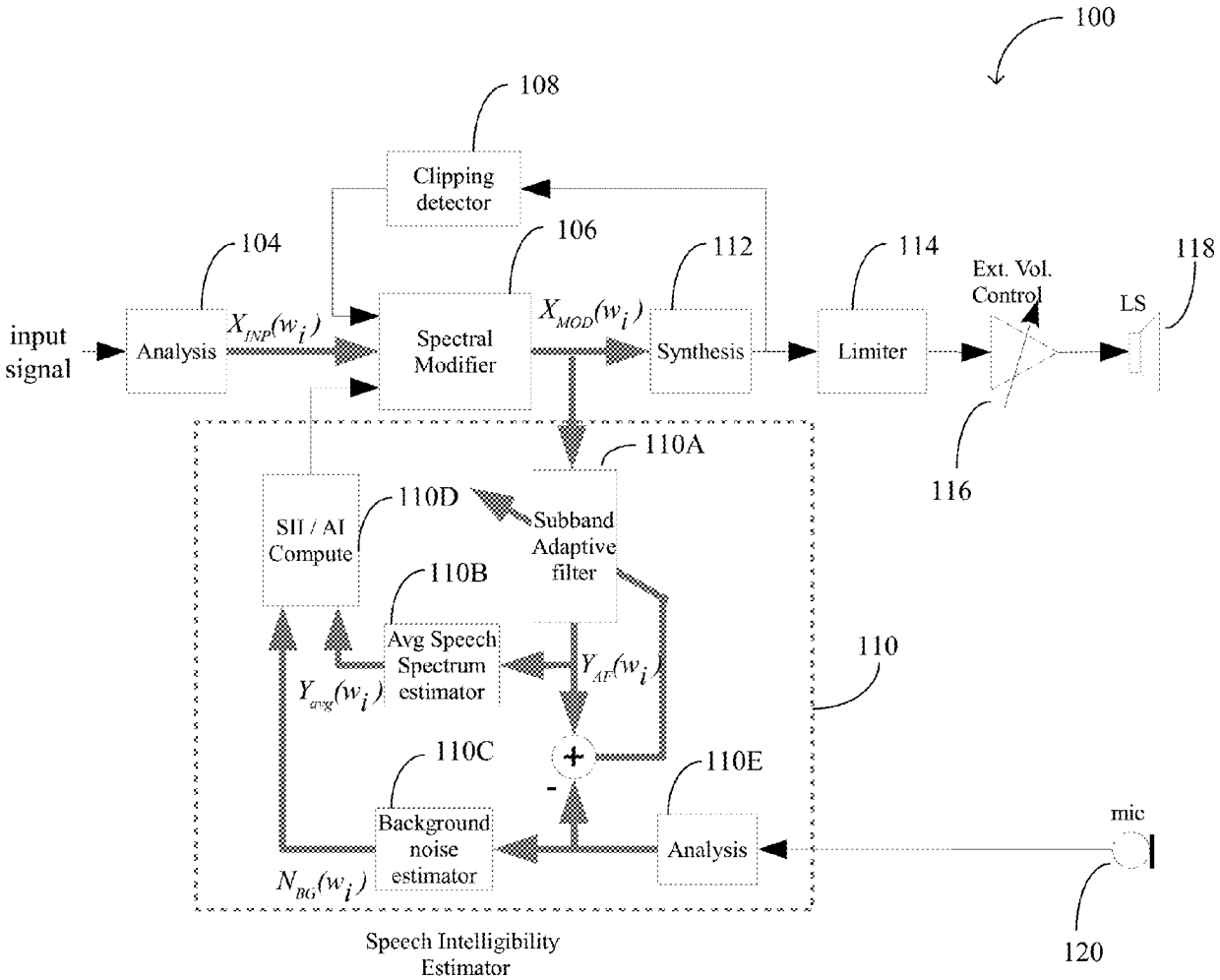
FIG. 3 illustrates a detailed block diagram of a speech intelligibility estimator that uses a subband adaptive filter according to a second embodiment.

FIG. 3 illustrates a detailed block diagram of a speech intelligibility estimator that uses a subband adaptive filter according to a second embodiment. The system 100 illustrated in FIG. 3 is similar to that described with reference to FIG. 2, however in this embodiment the output f the subband adaptive filter 110A may be used by the average speech spectrum estimator 110B rather than the coefficients of the filters of the subband adaptive filter 110A.

More specifically, in this particular embodiment the subband estimates $Y_{AF}(w_i)$ of the LS signal are not only used to update the filter coefficients of the subband adaptive filter 110A but are also sent to the average speech spectrum estimator 110B. The average speech spectrum estimator 110B then estimates the average speech spectrum based on the subband estimates $Y_{AF}(w_i)$ of the LS signal. In one particular embodiment, the average speech spectrum estimator 110B may estimate the medium- to long-term average speech spectrum and use this as an input to the SII/AI estimator 110D. In this particular example, such use may render the signal normalization module 102 redundant in which case the signal normalization module 102 may optionally be excluded.

Figure 4:
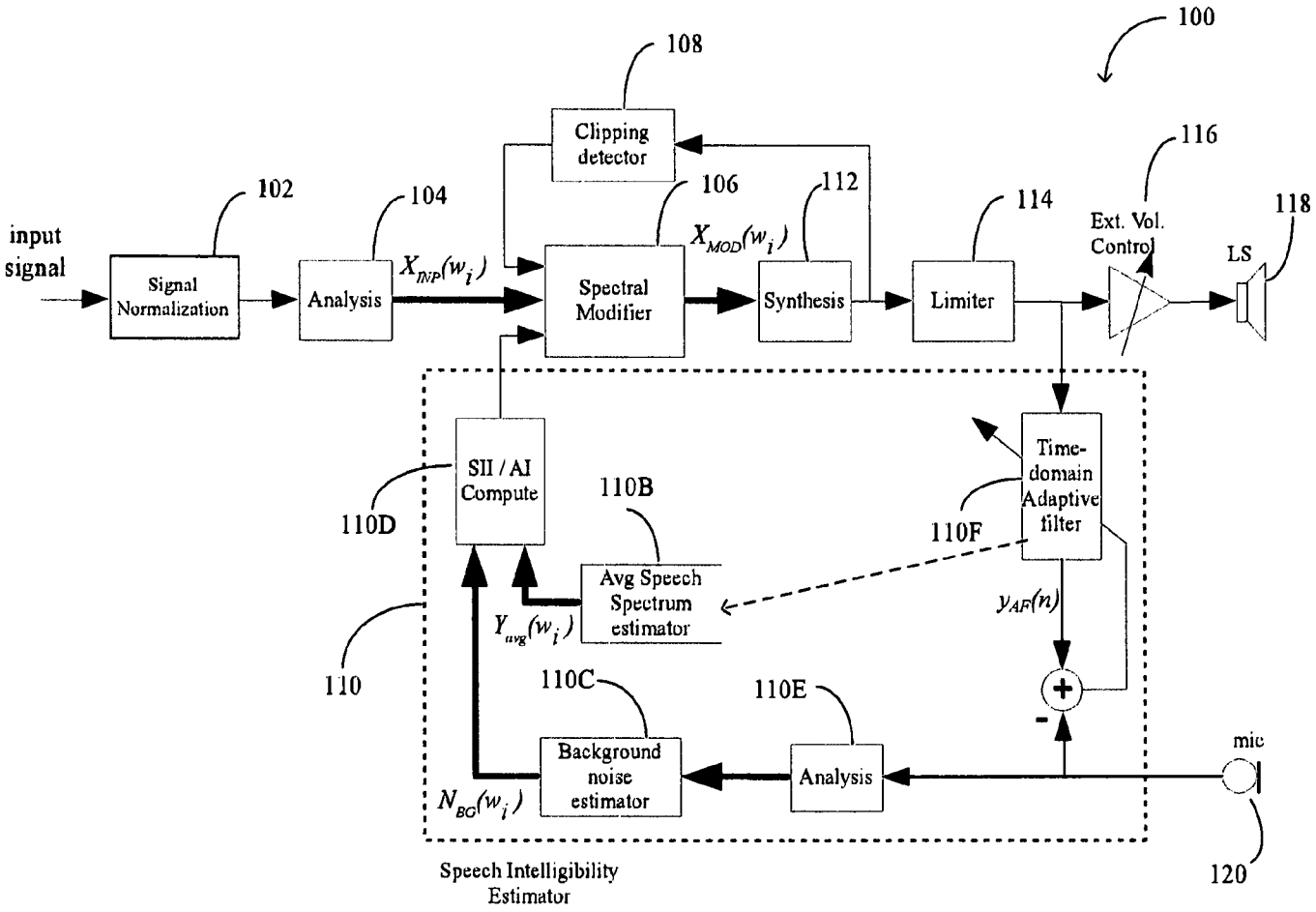
FIG. 4 illustrates a detailed block diagram of a speech intelligibility estimator that uses a time-domain adaptive filter according to a first embodiment.

FIG. 4 illustrates a detailed block diagram of a speech intelligibility estimator 110 that uses a time-domain adaptive filter according to a first embodiment. The speech intelligibility estimator 110 in this embodiment includes elements similar to those described with reference to FIG. 2 that operate similarly with exceptions as follows.

The speech intelligibility estimator 110 according to this embodiment includes a time-domain adaptive filter 110F. Generally, the adaptive filter 110F operates similar to the adaptive filter 110A described with reference to FIG. 2 except in this case operates in the time domain rather than in the frequency domain. The filter coefficients of the adaptive filter 110A, like those of adaptive filter 110A described with reference to FIG. 2, are used by the average speech spectrum estimator 110B to calculate the average speech magnitude spectrum at the microphone, $Y_{avg}(w_i)$. The output of the adaptive filter 110F $y_{AF}(n)$ is subtracted from the output signal of the microphone 120 and the result is used to calculate the coefficients of the time-domain adaptive filter 110F.

Specifically, the average speech magnitude spectrum at the microphone can be estimated from the time-domain adaptive-filter coefficients as $$Y_{avg}(w_i)=M(w_i)X_{avg}(w_i)G_{TD}(w_i)$$

where $$G_{TD}(w_i)=|H(e^{jw_i})|$$

$$H(z)=h(0)+h(1)z-1+\ldots+h(N-1)z-(N-1)$$

and h(n) is the nth coefficient of the adaptive filter.

Figure 5:
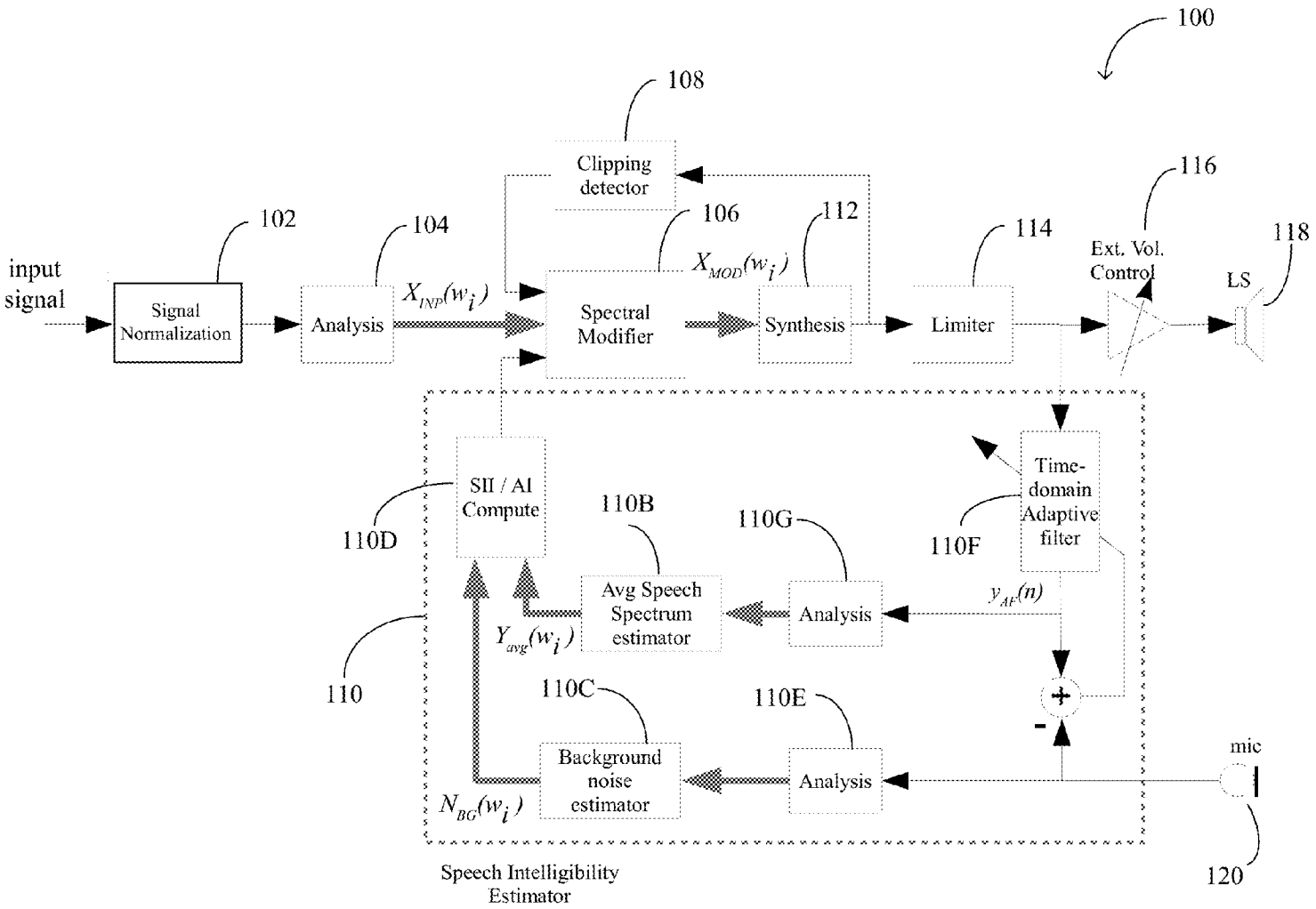
FIG. 5 illustrates a detailed block diagram of a speech intelligibility estimator that uses a time-domain adaptive filter according to a second embodiment.

FIG. 5 illustrates a detailed block diagram of a speech intelligibility estimator 110 that uses a time-domain adaptive filter according to a second embodiment. The speech intelligibility estimator 110 in this embodiment includes elements similar to those described with reference to FIG. 3 that operate similarly with exceptions as follows.

The speech intelligibility estimator 110 according to this embodiment includes a time-domain adaptive filter 110F. The adaptive filter 110F operates similar to the adaptive filter 110A described with reference to FIG. 3 except in this case operates in the time domain rather than in the frequency domain. The output of the time-domain adaptive filter 110F, like that of the subband adaptive filter 110A described with reference to FIG. 3, is sent to and used by the average speech spectrum estimator 110B to generate the average speech magnitude spectrum at the microphone, $Y_{avg}(w_i)$. In one particular embodiment and as illustrated in FIG. 5, the output $y_{AF}(n)$ may be sent to an analysis module 110G that transform the time-domain output $y_{AF}(n)$ into the frequency domain for subsequent communication to and processing by the average speech spectrum estimator 110B. The time-domain output of the adaptive filter 110F, $y_{AF}(n)$, may give a good estimate of the clean LS signal that is received at the microphone. A subband analysis of $y_{AF}(n)$ may then be carried out by the analysis module 110G to obtain the frequency-domain representation of the signal so that the average speech spectrum, $Y_{avg}(w_i)$, can be estimated.

It should be appreciated that embodiments are not necessarily limited to the systems described with reference to FIGS. 2 through 5 and the specific components of those systems as previously described. That is, other embodiments may include a system with more or fewer components, or components arranged in a different manner.

Figure 6:
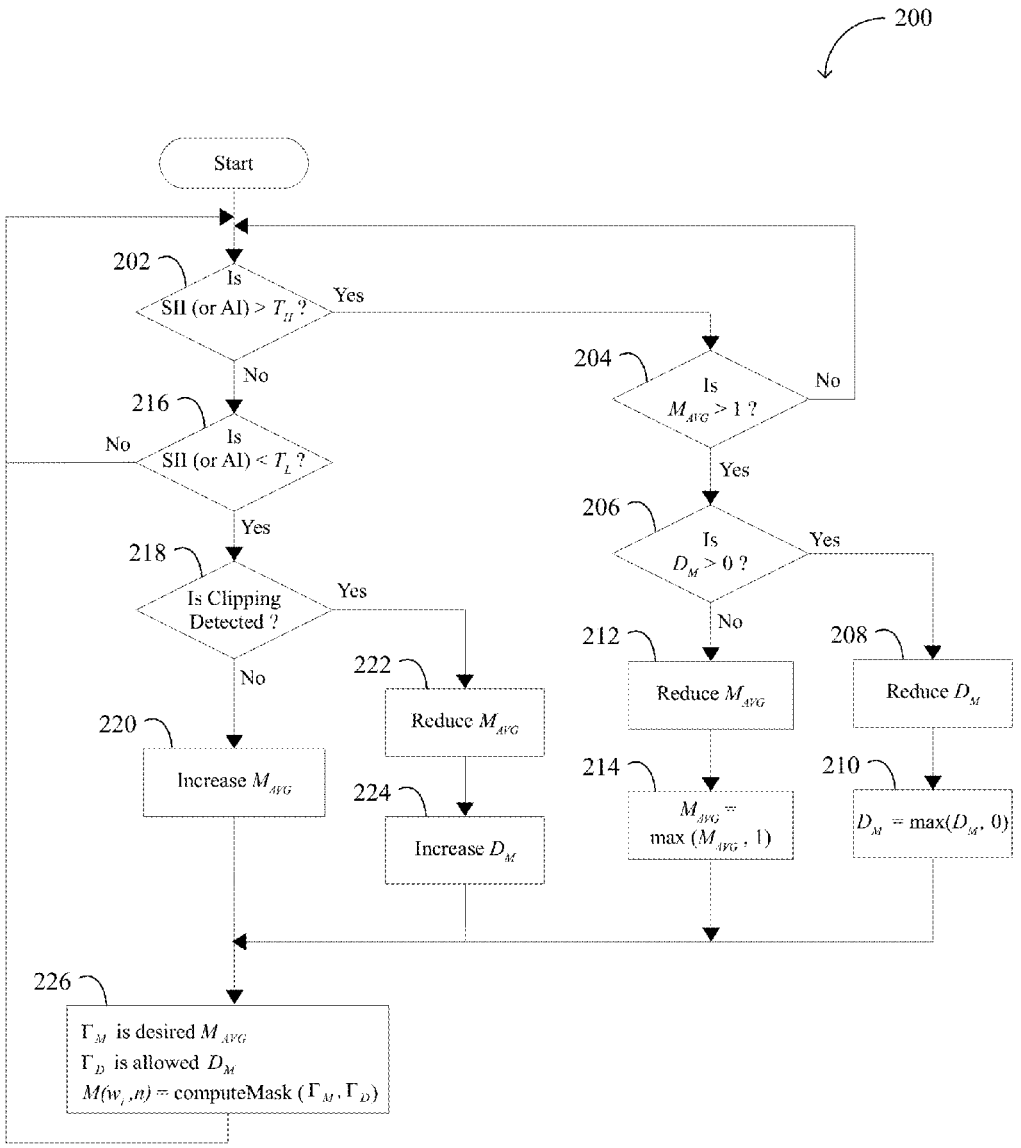
FIG. 6 illustrates a flowchart of an algorithm to compute the spectral mask that is applied on the spectral frame of the LS signal in order to improve the speech intelligibility.

FIG. 6 illustrates a flowchart of operations for computing a spectral mask $M(w_i)$ that may be applied on the spectral frame of the input signal to improve intelligibility. The operations may be performed by, e.g., the spectral modifier 106. The input signal may be modified by applying a spectral mask on the spectral frame of the input signal. If $X_{INP}(w_i, n)$ is the nth spectral frame of the input signal before the spectral modification, the modified signal after applying the spectral mask, $M(w_i, n)$, is given by $$X_{MOD}(w_i n)=M(w_i, n)X_{INP}(w_i, n)$$

The spectral mask is computed on the basis of the prescribed average spectral mask magnitude, $M_{AVG}$, and the maximum spectral distortion threshold, $D_M$, that are allowed on the signal. These parameters may be defined as $$M_{AVG} = \frac{1}{N}\sum_{i=1}^{N} M(w_i, n)$$

$$D_M = \left\| \frac{M(w_i, n)}{M_{AVG}} - 1 \right\|_\infty = \max_i \left| \frac{M(w_i, n)}{M_{AVG}} - 1 \right|$$

The parameters $M_{AVG}$ and $D_M$ may initialized to 1 and 0, respectively. This ensures that no modification is made to the spectral frame as the resulting mask is unity across all frequency bins. The required values of $M_{AVG}$ and $D_M$ may be adjusted using the following operations.

In operation 202, the spectral modifier 106 compares the SII (or AI) to a prescribed threshold $T_H$. If the estimated SII (or AI) is above the prescribed threshold $T_H$ then the speech intelligibility of the signal is excellent and either $M_{AVG}$ or $D_M$ may be reduced. Accordingly, processing may continue to operation 204.

In operation 204, it is determined whether $M_{AVG}>1$. If not, processing may return to operation 202. Otherwise, processing may continue to operation 206.

In operation 206, it is determined whether $D_M>0$. If so, then $D_M$ may be reduced by a prescribed amount and $M_{AVG}$ is not modified. For example, processing may continue to operation 208 where $D_M$ is reduced by the prescribed amount. In one particular embodiment, it may be ensured that $D_M$ is not reduced below 0. For example, processing may continue to operation 210 where $D_M$ is calculated as the maximum of $D_M$ and 0.

On the other hand, if $D_M$ is not greater than 0, then $M_{AVG}$ may be reduced by a prescribed amount. For example, processing may continue to operation 212 where $M_{AVG}$ is reduced by a prescribed amount. In one particular embodiment, it may be ensured that $M_{AVG}$ is not reduced below 1. For example, processing may continue to operation 214 where $M_{AVG}$ is calculated as the maximum of $M_{AVG}$ and 1.

Returning to operation 202, if the estimated SII (or AI) is less than $T_H$ but greater than a prescribed threshold $T_L$, where $T_H>T_L$, then the speech intelligibility is good enough and $M_{AVG}$ and $D_M$ are not modified. If the estimated SII (or AI) is below $T_L$ then the speech intelligibility of the LS signal is low and needs to be improved.

For example, if it is determined in operation 202 that SII (or AI) is not greater than $T_H$, then processing may continue to operation 216 where it is determined whether SII (or AI) is less than $T_L$. If not, processing may return to operation 202. Otherwise, processing may continue to operation 218.

In operation 218, it is determined whether clipping is detected. In one particular embodiment, this may be determined based on the output of the clipping detector 108. Using the clipping detector 108, the spectral modifier 106 may determine if some portion or all of the modified input signal has exceeded the predetermined dynamic range (i.e., getting clipped). If no clipping is detected, processing may continue to operation 220 where $M_{AVG}$ is increased by a prescribed amount and $D_M$ is set to 0. On the other hand, if clipping is detected, processing may continue to operation 222 where $M_{AVG}$ is decreased by a prescribed amount and operation 224 where $D_M$ is increased by a prescribed amount.

Finally, in operation 226 a new spectral mask $M(w_i, n)$ may be computed. Generally, the system may precompute the mask for different values of $M_{AVG}$ and $D_M$, store the precomputed masks in a look-up table, and for each calculated $M_{AVG}$ and $D_M$ pair the spectral modifier 106 may determined the precomputed mask that corresponds to that $M_{AVG}$ and $D_M$ pair based on the look-up table entries. The mask may be precomputed using an optimization algorithm, where the optimization algorithm maximizes the speech intelligibility of the input signal under the constraints that the average gain is equal to $M_{AVG}$ and the worst case distortion is equal to $D_M$. In one particular embodiment, if the measured values of $M_{AVG}$ and $D_M$ do not have specific entries in the look-up table but rather fall between a pair of entries, a weighted average of the precomputed masks may be used to estimate the mask that corresponds to the measured values of $M_{AVG}$ and $D_M$.

More specifically, a mask $M(w_i, n)$ may be computed for a particular $M_{AVG}$ and $D_M$ pair using the function computeMask( )) as $$M(w_i, n) = \text{computeMask}(\Gamma_M, \Gamma_D)$$

where $\Gamma_M$ is the desired $M_{AVG}$ and $\Gamma_D$ is the worst case $D_M$.

Note that in the steps to compute $M_{AVG}$ and $D_M$ above, the spectral distortion parameter $D_M$ is set to 0 as long as the modified signal is within the dynamic range. It is only when the signal has exceeded the maximum dynamic range, where increasing $M_{AVG}$ is no longer possible, that we allow $D_M$ to be non-zero in order to achieve better speech intelligibility. This way, we avoid distorting the modified signal unless it is absolutely necessary. Furthermore, the reduction or increase of the parameters $M_{AVG}$ and $D_M$ can be done either by using a leaky integrator or a multiplication factor, depending upon the application; in some cases, it may even be suitable to use a leaky integrator to increase the parameter values and a multiplication factor to decrease the values, or vice-versa.

The computation of the spectral mask may be done by optimizing either the SII or the AI while at the same time ensuring that $M_{AVG}$ and $D_M$ are maintained at their prescribed levels. However, the general form of the SII and AI functions are highly non-linear and non-convex and cannot be easily optimized to obtain the optimal spectral mask. To facilitate optimization of the spectral mask we may therefore relax some of the conditions that contribute minimally to the overall speech intelligibility measurement. For the computation of the SII, the upward spread of masking effects and the negative effects of high presentation level can be ignored for a normal-hearing listener in everyday situations. With these simplifications, the form of the equation for computing the simplified SII, $SII_{SMP}$, becomes similar to that of the AI and may be given by $$SII_{SMP}(\text{or } AI) = C_0 \sum_{k=1}^{K} I_i \alpha_k \quad \text{(Equation D-1)}$$

where $$\alpha_k = \begin{cases} A_H, & \sigma_k \geq A_H \\ A_L, & \sigma_k \leq A_L \\ \sigma_k, & \text{otherwise} \end{cases} \quad \text{(Equation D-2)}$$

$$\sigma_k = \frac{S_{sb}^{[dB]}(k) - N_{sb}^{[dB]}(k) + C_1}{C_2} \quad \text{(Equation D-3)}$$

$S_{sb}^{[dB]}(k)$ and $N_{sb}^{[dB]}(k)$ are the speech and noise spectral power in the $k^{th}$ band in dB, $I_k$ is the weight or importance given to the $k^{th}$ band, and $A_H$, $A_L$, $C_0$, $C_1$, and $C_2$ are appropriate constant values. For eg., a 5-octave AI computation, will have the following constant values: K=5, $C_0$=1/30, $C_1$=0, $C_2$=1, $A_H$=18, $A_L$=−12, $I_k$={0.072, 0.144, 0.222, 0.327, 0.234} with corresponding center frequencies $w_c(k)$={0.25, 0.5, 1, 2, 4} kHz. Similarly, a simplified SII computation can have the following values: K=18, $C_0$=1, $C_1$=15, $C_2$=30, $A_H$=1, $A_L$=0 where $I_k$ and the corresponding center frequencies are defined in the ANSI standard for a 5-octave SII.

If $M_{sb}^{[dB]}(k)$ is the corresponding spectral mask of $M(w_i, n)$ for the $k^{th}$ band, in dB, that is applied on the speech signal to improve the speech intelligibility, the speech intelligibility parameter $\sigma_k$ in eqn (D-3) after application of the spectral mask becomes $$\sigma_k = \frac{M_{sb}^{[dB]}(k) + S_{sb}^{[dB]}(k) - N_{sb}^{[dB]}(k) + C_1}{C_2} \quad \text{(Equation D-4)}$$

After application of the optimum spectral mask, we can assume that the modified speech has a nominal signal-to-noise ratio that is not at the extremes—that is, neither very bad nor very good. This assumption is reasonable since a speech signal that requires modification of the spectrum will not have an intelligibility that is excellent, while a speech signal after spectral modification would have an intelligibility that is satisfactory if the spectral modification is considered to be effective. With this assumption we can, in turn, assume that parameter $\sigma_k$ will always lie between the nominal limits $A_L$ and $A_H$ after spectral modification. Consequently, $\sigma_k$ in (D-2) becomes $\sigma_k=\sigma_k$ and eqn (D-1) can be expressed as $$SII_{SMP}(\text{or } AI) = \quad \text{(Equation D-5)}$$

$$\frac{C_0}{C_2}\sum_{k=1}^{K} I_k M_{sb}^{[dB]}(k) + \frac{C_0}{C_2}\sum_{k=1}^{K} I_k [S_{sb}^{[dB]}(k) - N_{sb}^{[dB]}(k) + C_1]$$

Note that eqn (D-5) is convex with respect to $M_{sb}^{[dB]}(k)$ and the minimization of eqn (D-5) is independent of the values of $S_{sb}^{[dB]}(k)$ and $N_{sb}^{[dB]}(k)$. Therefore, to obtain the optimum spectral mask with prescribed levels of $M_{AVG}$ and $D_M$ we solve the optimization problem given by $$\text{maximize } SII_{SMP} \text{ (or AI)}$$

$$\text{subject to: } M_{AVG}=\Gamma_M$$

$$D_M<\Gamma_D \quad \text{(Equation D-6)}$$

where $\Gamma_M$ is the prescribed value of $M_{AVG}$ and $\Gamma_D$ is the upper limit of $D_M$. Since the second term in eqn (D-5) is independent of the spectral mask, maximization of eqn (D-5) with respect to the spectral mask is therefore equivalent to maximization of only the first term in eqn (D-5). With this modification, and denoting the normalized spectral mask $M(w_i, n)$ as $$\overline{M}_i = \frac{M(w_i, n)}{M_{AVG}} \quad \text{(Equation D-7)}$$

the problem in eqn (D-6) can be expressed as a convex optimization problem given by $$\text{minimize} -\Sigma_{i=1}^{N} \gamma_i \log \overline{M}_i$$

$$\text{subject to: } \Sigma_{i=1}^{N} \overline{M}_i=1$$

$$|\Sigma_{i=1}^{N} \overline{M}_i-1|\leq\Gamma_D \quad \text{(Equation D-8)}$$

where $$\gamma_i=I_k \text{ when } w_i \in k^{th} \text{ band}$$

and $\overline{M}_i$ (i=1, N) are the optimization variable. Since eqn (D-8) is a convex optimization problem the corresponding solution is a value of $\overline{M}_i$ that is globally optimal. In actual implementation, the optimum values of $\overline{M}_i$ can be pre-computed for various values of $\Gamma_D$, and the optimal mask can be obtained by a lookup table or an interpolating function as $$M(w_i, n)=\text{computeMask}(\Gamma_M, \Gamma_D) \quad \text{(Equation D-9)}$$

where $$\text{computeMask}(\Gamma_M, \Gamma_D)=\Gamma_M \overline{M}_i^{(opt)}(\Gamma_D) \quad \text{(Equation D-10)}$$

and $\overline{M}_i^{(opt)}(\Gamma_D)$ is the solution of the optimum value of $\overline{M}_i$ in eqn (D-8) for a given value of $\Gamma_D$.

It should be appreciated that embodiments are not necessarily limited to the method described with reference to FIG. 6 and the operations described therein. That is, other embodiments may include methods with more or fewer operations, operations arranged in a different time sequence, or operations with slightly modified but functionally substantively equivalent operations. For example, while in operation 206 it is determined whether $D_M>0$, in other embodiments it may be determined whether $D_M\geq0$. For another example, in one embodiment when it is determined that SII (or AI) is not less than $T_L$, processing may perform operation 218 and determine whether clipping is detected. If clipping is not detected, processing may return to operation 202. However, if clipping is detected, $M_{AVG}$ may be decreased as described with reference to operation 222 before turning to operation 202.

Figure 7:
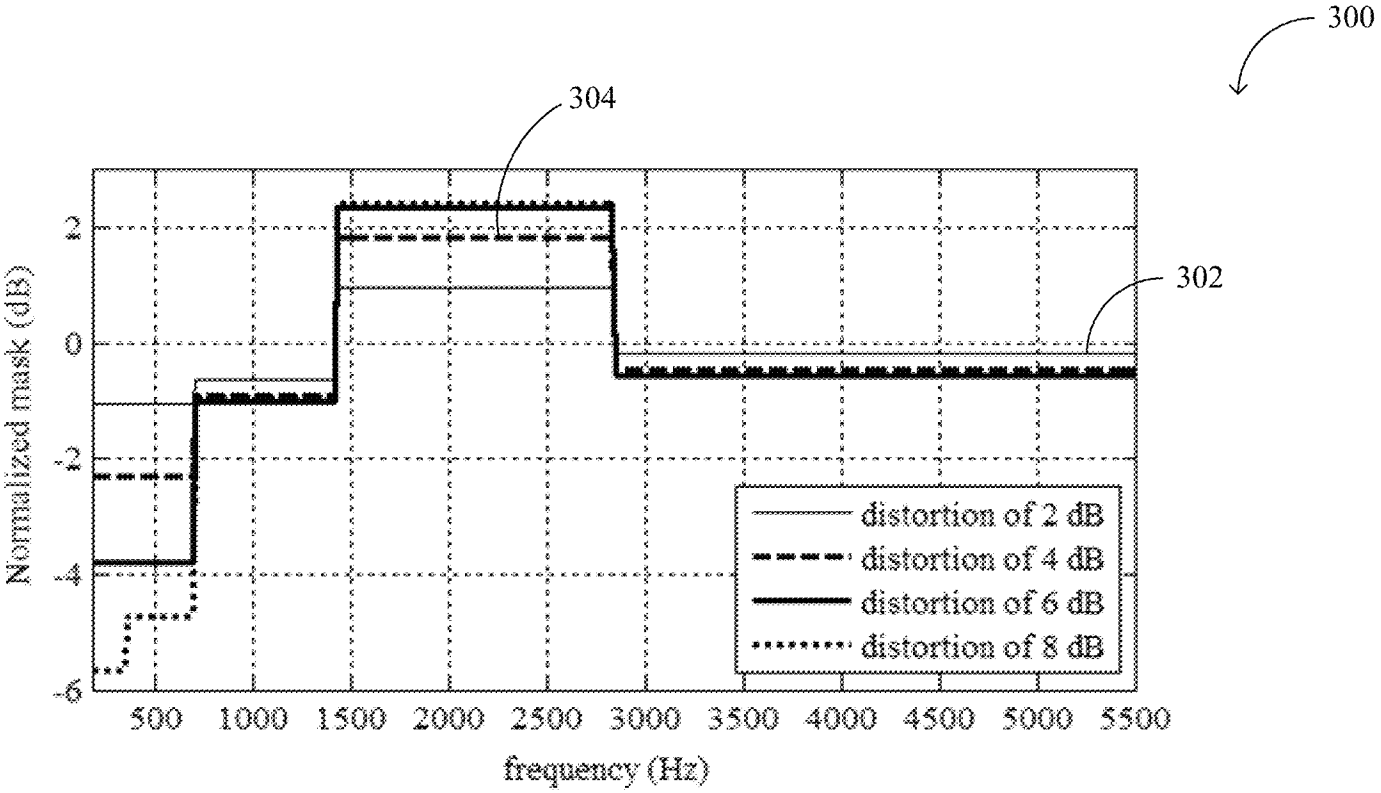
FIG. 7 illustrates an exemplary optimal normalized mask for various distortions levels.

FIG. 7 illustrates exemplary magnitude functions of normalized masks that have been optimized for various distortion levels. Generally, different masks may have unique magnitude functions with respect to frequency for an allowable level of distortion. In this particular example, four different magnitude functions for four different masks are illustrated, where the masks are optimized for allowable levels of distortion ranging from 2 dB to 8 dB. For example, curve 302 represents a magnitude function of an optimal normalized mask for an allowable distortion of 2 dB, whereas curve 304 represents a magnitude function of an optimal normalized mask for an allowable distortion of 4 dB.

In one particular embodiment, the magnitude functions are obtained by using eqn (D-8) to find the optimal masks that optimize a 5-octave AI with $I_k$={0.072, 0.144, 0.222, 0.327, 0.234} and center frequencies $w_c(k)$={0.25, 0.5, 1, 2, 4} kHz. The specific mask magnitude function curves illustrates in FIG. 7 were generated by maximizing this 5-octave AI for distortion levels ranging from 2 to 8 dB.

Figure 8:
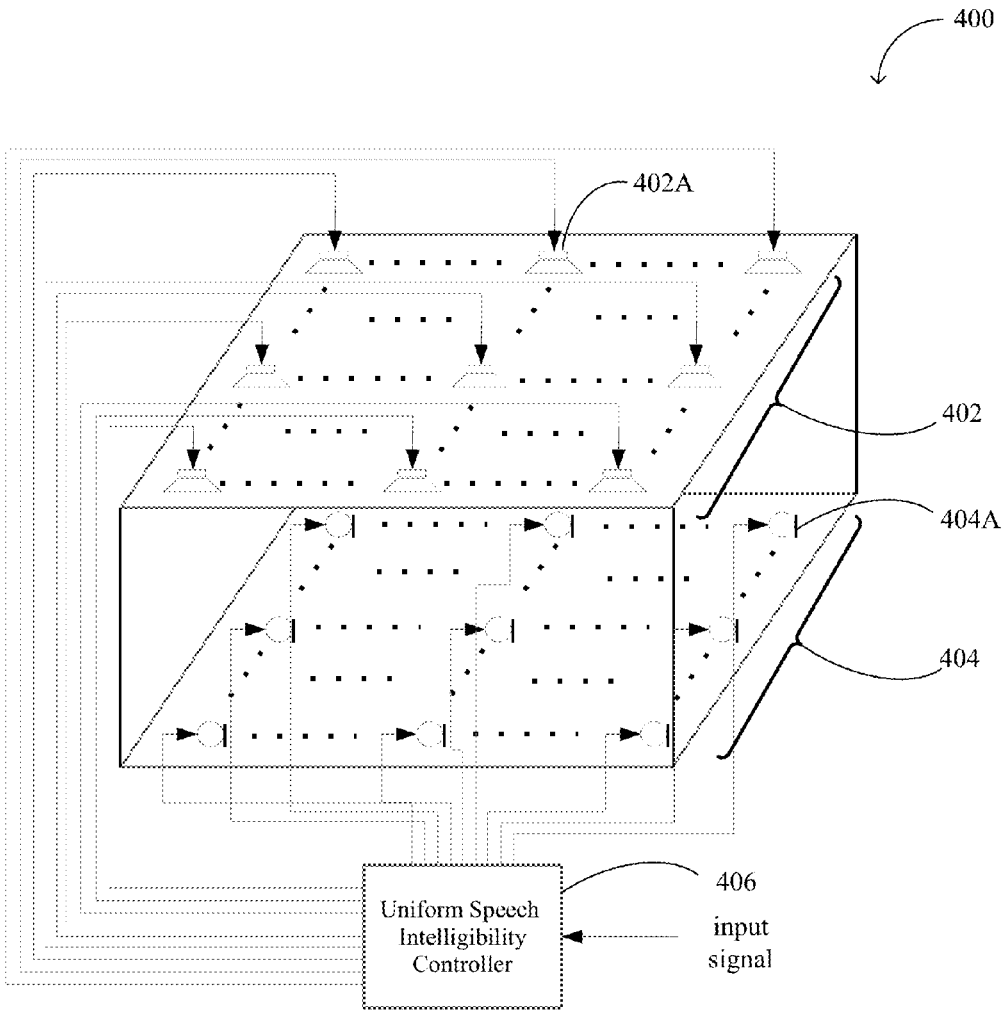
FIG. 8 illustrates a block diagram of a multi-microphone multi-loudspeaker speech intelligibility optimization system.

FIG. 8 illustrates a block diagram of a multi-microphone multi-loudspeaker speech intelligibility optimization system 400. The system 400 may include a loudspeaker array 402, a microphone array 404, and a uniform speech intelligibility controller 406. The loudspeaker array 402 may include a plurality of loudspeakers 402A, while the microphone array 404 may include a plurality of microphones 404A.

The system 400 may provide improvement of the intelligibility of a loudspeaker (LS) signal across a region within an enclosure. Using multiple microphones, which may be distributed at known relative positions across the region, the level of speech intelligibility across the region may determined. From the knowledge of the distribution of the speech intelligibility across the region, the input signal may be appropriately adjusted, using a beamforming technique, to increase uniformity of speech intelligibility across the region. In one particular embodiment, this may be done by increasing the sound energy in locations where the speech intelligibility is low and reducing the sound energy in locations where the intelligibility is high.

Figure 9:
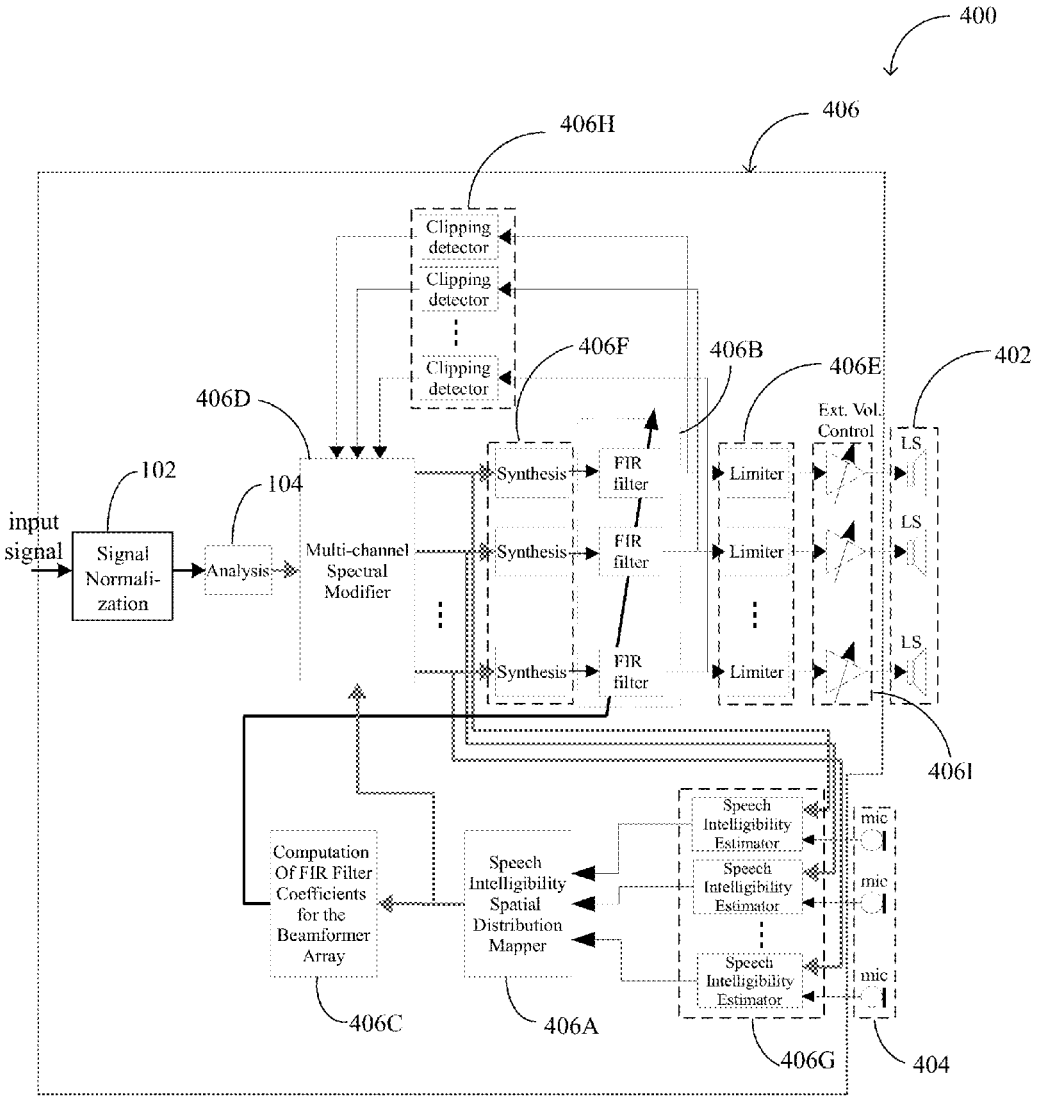
FIG. 9 illustrates a block diagram of a system for estimating and improving the speech intelligibility over a prescribed region in an enclosure.

FIG. 9 illustrates a block diagram of a system 400 for estimating and improving the speech intelligibility over a prescribed region in an enclosure. The system 400 includes a signal normalization module 102, an analysis module 104, a uniform speech intelligibility controller 406, an array of loudspeaker 402, and an array of microphones 404. The controller 406 includes a speech intelligibility spatial distribution mapper 406A, an LS array beamformer 406B, a beamformer coefficient estimator 406C, a multi-channel spectral modifier 406D, an array of limiters 406E, an array of synthesis banks 406F, an array of speech intelligibility estimators 406G, an array of clipping detectors 406H, and an array of external volume controls 406I.

Generally, structurally, the uniform speech intelligibility controller 406 includes multiple versions of the components previously described with reference to FIGS. 1 through 5, one set of components for each microphone. Functionally, the uniform speech intelligibility controller 406 computes the spatial distribution of the speech intelligibility across a prescribed region and adjusts signal to the loudspeaker array such that uniform intelligibility is attained across the prescribed region.

Some components in system 400 are the same as previously described such as the signal normalization module 102 and the analysis module 104. The uniform speech intelligibility controller 406 also includes arrays of various components where the individual elements of each array are similar to the corresponding individual elements previously described. For example, the uniform speech intelligibility controller 406 includes an array of clipping detectors 406H including a plurality of individual clipping detectors each similar to previous described clipping detectors 108, an array of synthesis banks 406F including a plurality of synthesis banks each similar to previously described synthesis bank 112, an array of limiters 406E including a plurality of limiters each similar to previously described limiters 114, an array of speech intelligibility estimators 406G including a plurality of speech intelligibility estimators similar to previously described speech intelligibility estimator 110, and an array of external volume controls 406I including a plurality of external volume controls each similar to previously described external volume control 116.

The multi-channel spectral modifier module 406D receives the subband components output from the analysis module 104 and performs various processing on those components. Such processing includes modifying the magnitude of the subband components by generating and applying multi-channel spectral masks that are optimized for improving the intelligibility of the signal across a prescribed region. To perform such modification, the multi-channel spectral modifier module 406D may receive the output of the analysis module 104 and, in some embodiments, the outputs of an array of clipping detectors 406H and/or speech intelligibility spatial distribution mapper 406A.

The array of synthesis banks 406F in this particular embodiment receives the outputs of the multi-channel spectral modifier 406D which, in this particular example, are multichannel subband component outputs that each correspond to one of the plurality of loudspeakers included in the array of loudspeakers 402 and recombines those multichannel subband components to form multichannel time-domain signals. Such recombination of multichannel subband components may be performed by using an array of one or more analog or digital filters arranged in, for example, a filter bank.

The array of clipping detectors 406H receives the outputs of the LS array beamformer 406B and based on those outputs detect if one or more of the multichannel signals as modified by the multi-channel spectral modifier module 406D has exceeded one or more predetermined dynamic ranges. The array of clipping detectors 406H may then communicate a signal array to the multi-channel spectral modifier module 406D indicative of whether each of the multi-channel input signals as modified by the multi-channel spectral modifier module 406D has exceeded the predetermined dynamic range. For example, a single component of the array of clipping detectors 406H may output a first value indicating that the modified input signal of that component has exceeded the predetermined dynamic range associated with that component and a second (different) value indicating that the modified input signal has not exceeded that predetermined dynamic range. In some embodiments, a single component of the array of clipping detectors 406H may output information indicative of the extent of the dynamic range being exceeded or not. For example, a single component of the array of clipping detectors 406H may indicate by what magnitude the dynamic range has been exceeded.

The speech intelligibility spatial distribution mapper 406A uses the speech intelligibility measured by the array of speech intelligibility estimators 406G at each of the microphones and the microphone positions, and maps the speech intelligibility level across the desired region within the enclosure. This information may then be used to distribute the sound energy across the region so as to provide uniform speech intelligibility.

The module 406C computes the FIR filter coefficients for the LS array beamformer 406B using the information provided by the speech intelligibility spatial distribution mapper 406A and adjusts the FIR filter coefficients of the LS array beamformer 406B so that more sound energy is directed towards the areas where the speech intelligibility is low. In other embodiments, sound energy may not necessarily be shifted towards areas where speech intelligibility is low, but rather towards areas where increased levels of speech intelligibility are desired. The computation of the filter coefficients can be done using optimization methods or, in some embodiments, using other (non-optimization-based) methods. In one particular embodiment, the filter coefficients of the LS array can be pre-computed for various sound-field configurations, which can then be combined together in an optimal manner to obtain the desired beamformer response.

In operation, the microphones in the array 404 may be distributed throughout the prescribed region. The audio signals measured by those microphones may each be input into a respective speech intelligibility estimator, where each speech intelligibility estimator may estimate the SII or AI of its respective channel. The plurality of SII/AI may then be fed into the speech intelligibility spatial distribution mapper 406A which, as discussed above, maps the speech intelligibility levels across the desired region within the enclosure. The mapping may then be input into the computational module 406C and multi-channel spectral modifier 406D. The computation module 406C may, based on that mapping, determine the filter coefficients for the FIR filters that constitute the LS array beamformer 406B.

For the input signal path, the input signal may be input into and normalized by the signal normalization module 102. The normalized input signal may then be transformed by the analysis module 104 into the frequency domain subbands for subsequent input into the multi-channel spectral modifier 406D. The multi-channel spectral modifier 406D may then modify the magnitude of those subband components by generating and applying the previously described spectral masks. The output of the multi-channel spectral modifier 406D may then be input into the array of synthesis filters 406F for subsequent recombination into the individual channels. The output of the array 406F may then be input into the beamformer 406B for redistributing sound energy into suitable channels. The output of beamformer 406B may then be sent to the limiter 406E and subsequently output via the loudspeaker array 402.

It should be appreciated that the array of speech intelligibility estimators 406G may include speech intelligibility estimator(s) that are similar to any of those previously described, including speech intelligibility estimators that operate in the frequency domain as described with reference to FIGS. 2 and 3 and/or in the time domain as described with reference to FIGS. 4 and 5.

It should be appreciated that embodiments are not necessarily limited to the systems described with reference to FIGS. 8 and 9 and the specific components of the systems described with reference to those figures. That is, other embodiments may include a system with more or fewer components. For example, in some embodiments, the signal normalization module 102 may be excluded, the clipping detector array 406H may be excluded, and/or the limiter array 406E may be excluded. Further, there may not necessarily be a one-to-one correspondence between input and output channels. For example, a single microphone input may generate output signals for two or more loudspeakers, and similarly multiple microphone inputs may generate output signals for a single loudspeaker.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered as illustrative and not restrictive, and the inventive body of work is not to be limited to the details given herein, which may be modified within the scope and equivalents of the appended claims.

What is claimed is:

1. A method for adjusting spectral characteristics of a signal, comprising:
- measuring an audio signal;
- calculating an index indicative of speech intelligibility of the audio signal;
- comparing the index to a threshold value; and
- when the index does not exceed the threshold value:
  - determining whether a gain of an input signal can be increased; and
  - when the gain of the input signal cannot be increased: modifying a spectral shape of the input signal.

2. The method of claim 1, further comprising:
- when the gain of the input signal can be increased:
  - increasing the gain of the input signal.

3. The method of claim 1, further comprising:
- when the gain of the input signal cannot be increased:
  - decreasing the gain of the input signal.

4. The method of claim 1, wherein determining whether the gain of the input signal can be increased includes detecting clipping of the input signal.

5. The method of claim 1, wherein modifying the spectral shape of the input signal includes optimally adjusting the spectral shape of the input signal to maximize the speech intelligibility for a given distortion level.

6. The method of claim 1, wherein the index indicative of speech intelligibility of the audio signal is calculated based on:
- an estimate of an average speech spectrum at a microphone that provides the audio signal; and
- an estimate of background noise at the microphone.

7. The method of claim 6, further comprising:
- estimating the average speech spectrum at the microphone based on coefficients of a subband adaptive filter.

8. The method of claim 6, further comprising:
- estimating the average speech spectrum at the microphone based on an output of a subband adaptive filter.

9. The method of claim 1, further comprising:
- when the index does exceed the threshold value:
  - reducing a magnitude of the modification of the spectral shape.

10. The method of claim 9, further comprising:
- when the index does exceed the threshold value:
  - once the modifications to the spectral shape of have been removed, reducing a gain of the input signal.

11. The method of claim 1, wherein modifying the spectral shape of the input signal includes:
- modifying the spectral shape of the input signal based on a first spectral mask defined for a first level of distortion.

12. The method of claim 11, wherein modifying the spectral shape of the input signal includes:
- determining whether the index continues to not exceed the threshold value; and
- when it is determined that the index continues to not exceed the threshold value:
- modifying the spectral shape of the input signal based on a second spectral mask defined for a second level of distortion that is greater than the first level of distortion.

13. The method of claim 11, further comprising:
- determining an upper threshold value, wherein the threshold value is the upper threshold value; and
- determining a lower threshold value that is less than the upper threshold value;
- wherein:
  - determining whether the gain of the input signal can be increased is performed when the index does not exceed the upper threshold value and is less than the lower threshold value.

14. The method of claim 11, further comprising:
- determining an upper threshold value, wherein the threshold value is the upper threshold value;
- determining a lower threshold value that is less than the upper threshold value; and
- when the index exceeds the upper threshold value:
  - reducing a magnitude of the modification of the spectral shape.

15. A system for estimating and improving speech intelligibility over a prescribed region in an enclosure, comprising:
- a plurality of microphones for receiving an audio signal;
- a plurality of speakers for generating an output signal from an input signal; and a uniform speech intelligibility controller coupled to the microphones and the speakers, the uniform speech intelligibility controller including:

a beamformer configured to receive a modified input signal, redistribute sound energy of the received input signal, and communicate signals indicative of the redistributed sound energy to the speakers;

a plurality of speech intelligibility estimators each coupled to at least one of the microphones and configured to estimate a speech intelligibility at the corresponding at least one microphone;

a speech intelligibility spatial distribution mapper coupled to the speech intelligibility estimators and configured to map the estimated speech intelligibilities across a desired region; and a beamformer filter coefficient computation module coupled to the speech intelligibility spatial distribution mapper and configured to adjust filter coefficients of the beamformer for sound energy redistribution.

16. The system of claim 15, wherein the uniform speech intelligibility controller further includes a multi-channel spectral modifier configured to receive an input signal and modify a spectrum of the input signal to generate the modified input signal.

17. The system of claim 16, wherein the multi-channel spectral modifier is configured to modify the spectrum of the input signal to maximize speech intelligibility of the signals output by the speakers based on a prescribed average gain and distortion level.

18. The system of claim 16, wherein the uniform speech intelligibility controller further includes a plurality of clipping detectors arranged between the multi-channel spectral modifier and the beamformer, the clipping detectors configured to determine whether signals output from the beamformer are clipping.

19. The system of claim 16, wherein the uniform speech intelligibility controller further includes a plurality of limiters arranged between the beamformer and the speakers, the limiters configured to attenuate signals that exceed a predetermined dynamic range with minimal audible distortion.

20. The system of claim 15, wherein the speech intelligibility spatial distribution mapper and plurality of speech intelligibility estimators form a single module, and the multi-channel spectral modifier and the beamformer form a single module.

* * * * *